US006185900B1

(12) United States Patent
Martin et al.

(10) Patent No.: US 6,185,900 B1
(45) Date of Patent: Feb. 13, 2001

(54) METHOD AND APPARATUS FOR STRETCH WRAPPING A LOAD

(75) Inventors: Curtis Martin, Floyds Knobs, IN (US); Patrick R. Lancaster, III, Louisville, KY (US)

(73) Assignees: Lantech Management Corp.; Lantech Holding Corp. Lantech, Inc., both of Louisville, KY (US)

( * ) Notice: Under 35 U.S.C. 154(b), the term of this patent shall be extended for 0 days.

(21) Appl. No.: 09/292,006

(22) Filed: Apr. 15, 1999

(51) Int. Cl.[7] ..... B65B 11/04

(52) U.S. Cl. ..... 53/211; 53/118; 53/203; 53/211; 53/399

(58) Field of Search ..... 53/399, 118, 211, 53/203

(56) References Cited

U.S. PATENT DOCUMENTS

| | | | | |
|---|---|---|---|---|
| 4,000,820 | * | 1/1977 | Kurk et al. | 214/6 DK |
| 4,216,640 | * | 8/1980 | Kaufman | 53/556 |
| 4,300,326 | * | 11/1981 | Stackhouse | 53/211 |
| 4,432,185 | * | 2/1984 | Geisinger | 53/138 |
| 4,563,863 | * | 1/1986 | Humphrey | 53/556 |
| 4,619,102 | * | 10/1986 | Geisinger | 53/399 |
| 4,747,252 | * | 5/1988 | Kapke | 53/399 |
| 4,845,920 | * | 7/1989 | Lancaster | 53/399 |
| 4,972,656 | * | 11/1990 | Haugstad | 53/176 |
| 4,995,224 | | 2/1991 | Yourgalite et al. | 53/540 |
| 5,005,335 | * | 4/1991 | Yourgalite et al. | 53/399 |
| 5,138,818 | * | 8/1992 | Humphrey | 53/556 |
| 5,168,691 | * | 12/1992 | Errani | 53/537 |
| 5,447,009 | * | 9/1995 | Oleksy et al. | 53/399 |
| 5,564,258 | * | 10/1996 | Jones, Sr. et al. | 53/399 |
| 5,718,099 | * | 2/1998 | Fantz et al. | 53/399 |
| 5,720,153 | * | 2/1998 | Martin-Cocher | 53/399 |
| 5,916,109 | * | 6/1999 | Espinosa | 53/397 |
| 5,941,049 | * | 8/1999 | Lancaster, III et al. | 53/399 |

FOREIGN PATENT DOCUMENTS

| | | | |
|---|---|---|---|
| 0 517 502 A1 | | 6/1991 | (EP) . |
| 2014107 | * | 8/1979 | (GB) . |
| 2216489 | * | 10/1989 | (GB) . |
| 0430902 A1 | * | 6/1991 | (GB) . |

* cited by examiner

*Primary Examiner*—Peter Vo
*Assistant Examiner*—Chris Harmon
(74) *Attorney, Agent, or Firm*—Finnegan, Henderson, Farabow, Garrett & Dunner, L.L.P.

(57) ABSTRACT

A leading end of packaging material is grasped in a packaging material holder while a load is wrapped. Packaging material is dispensed from a packaging material dispenser, and relative rotation is provided between the dispenser and a load to wrap packaging material around the load. The packaging material holder is positioned on the rotating surface of a turntable but is isolated from any electrical or fluid power source of a rotatable surface of the turntable. During the wrapping cycle, a spring builds and stores energy as the packaging material holder moves downstream along the turntable, automatically releasing the leading end of the packaging material and automatically grasping a trailing end of the packaging material. At least a portion of the packaging material is cut between the packaging material holder and the load, and the spring releases the stored energy to move the packaging material holder upstream toward the dispenser.

27 Claims, 18 Drawing Sheets

METHOD AND APPARATUS FOR STRETCH WRAPPING A LOAD

BACKGROUND OF THE INVENTION

The present invention relates to a method and apparatus for wrapping a load with packaging material.

Loads have been stretch wrapped with stretch wrap packaging material by securing a leading end of the packaging material to the load or a turntable clamp, dispensing the packaging material by providing relative rotation between the load and a packaging material dispenser to cause the load to be enveloped by the packaging material, and severing the packaging material between the load and a packaging material dispenser. The relative rotation between the load and the dispenser can be provided either by rotating the load on a turntable, or by translating the dispenser around a stationary load. Stretch wrapping usually employs a web of stretch film as the packaging material, and the machinery can be either automatic or semi-automatic.

Semi-automatic stretch wrapping machinery requires the operator to attach a leading end of the packaging material to the load for each load to be wrapped. Typically, this is accomplished by forming a rope in the leading end of the film and then inserting the leading end between the layers of the load or by tying the end of the packaging material to the edge of the supporting wood pallet or any suitable outcropping on the load. This attachment must be relatively strong since it provides the reaction to force needed to pull the film from the film dispenser during the initiation of the relative rotation between the load and the film dispenser. The attachment or tying of the film makes film removal more difficult after the load has been shipped to its destination.

Automatic stretch wrapping machines are significantly more expensive than semi-automatic machines. The automatic machines typically use film clamps that grip the film web between two opposed surfaces, use electrical or pneumatic actuators to open and close the clamps, typically supply electrical or pneumatic power to the actuators on a turntable through the journal of the turntable, and use hot wires or other expensive cutting devices are used to cut the film. Such film clamps create a "tenting" effect during wrapping due to the distance between the clamp and the load during wrapping, resulting in wasted film and loosely wrapped loads.

In light of the cost of such automatic machines, there is a need for a method and apparatus for wrapping a load with packaging material that operates as effectively as those previously developed to allow automatic release and clamping of portions of the packaging material but which can be manufactured at a lower cost.

SUMMARY OF THE INVENTION

Accordingly, the present invention is directed to a method and apparatus for wrapping a load with packaging material, which provides advantages over and obviates several problems associated with earlier methods and apparatus for wrapping a load. To achieve these and other advantages and in accordance with the purpose of the invention, as embodied and broadly described, the invention concerns an apparatus for wrapping a load with packaging material, including an apparatus for wrapping a load with packaging material, including a dispenser for dispensing packaging material, a rotatable turntable for providing relative rotation between the dispenser and the load to wrap packaging material around the load, and a packaging material holder mounted on the rotatable turntable and isolated from any electrical or fluid power source by the rotatable turntable for automatically grasping and releasing portions of the packaging material, the packaging material holder including means for building and storing energy, and for releasing the stored energy to move the packaging material holder.

According to a further aspect of the present invention, there is provided a method of wrapping a load with packaging material, including a method of wrapping a load with packaging material including holding a leading end of the packaging material with a packaging material holder mounted on a rotatable turntable and isolated from any electrical or fluid power source by the rotatable turntable, dispensing packaging material from a packaging material dispenser and rotating the turntable to wrap packaging material around sides of the load, automatically cutting at least a portion of the packaging material between the load and the packaging material dispenser, and moving the packaging material holder by automatically building and storing energy in the packaging material holder, and automatically releasing the stored energy.

Additional features and advantages of the invention will be set forth in the description which follows, and in part will be apparent from the description, or may be learned by practice of the invention. The objects and other advantages of the invention will be realized and attained by the method and apparatus particularly pointed out in the written description and claims as well as the appended drawings.

It is to be understood that both the foregoing general description and the following detailed description are exemplary and explanatory and are intended to provide further explanation of the invention as claimed. The accompanying drawings are included to provide a further understanding of the invention and are incorporated in and constitute a part of the specification, illustrate an embodiment of the invention, and together with the description serve to explain the principles of the invention.

DETAILED DESCRIPTION OF THE PREFERRED EMBODIMENTS

Figure 1A:
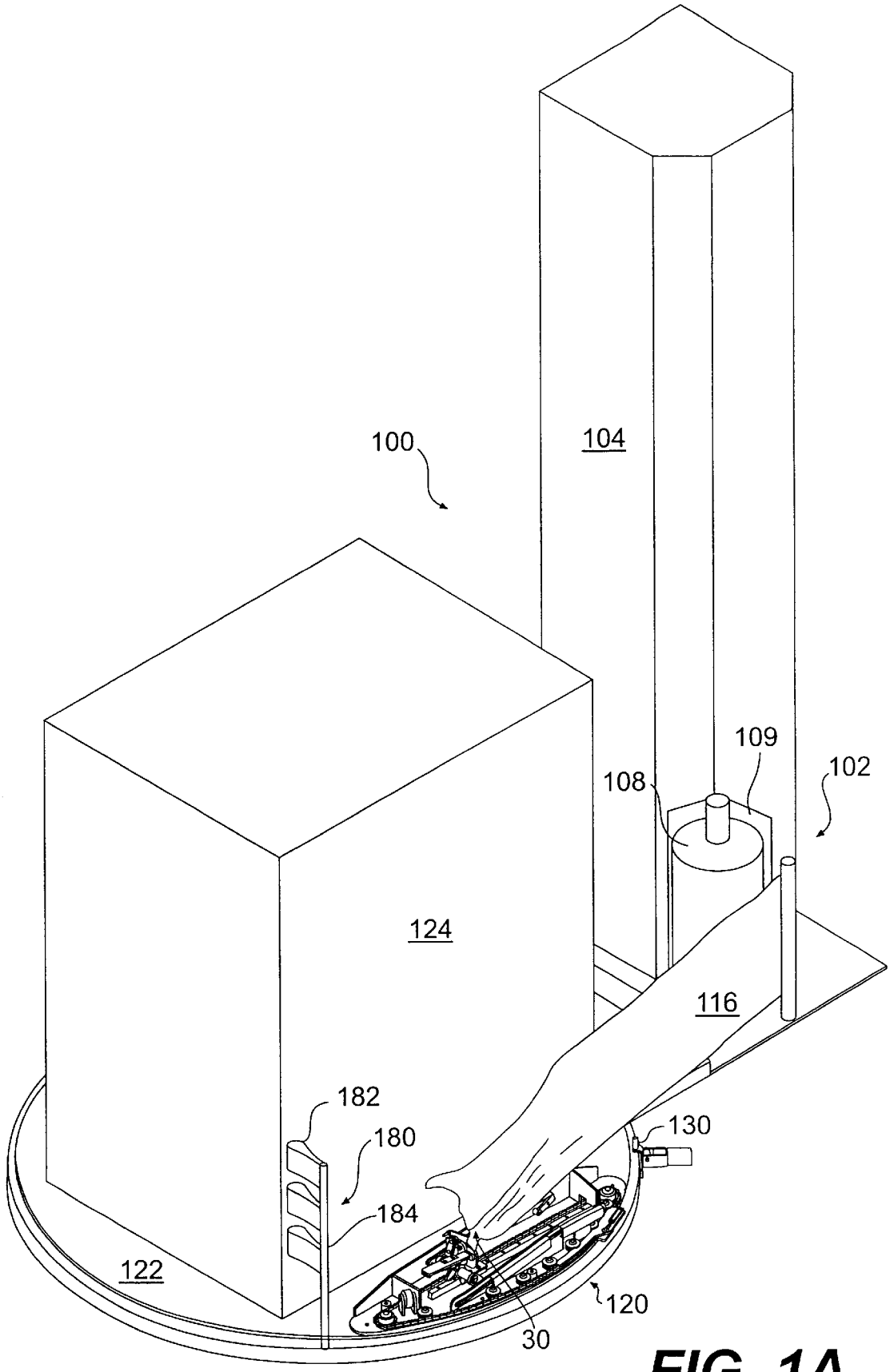
FIG. 1A is a perspective view of the load wrapping apparatus of the present invention.

The following text and accompanying drawings illustrate examples of the present preferred embodiments of the present invention.

According to the invention, an apparatus is provided for wrapping a load with packaging material. As embodied herein and shown in FIGS. 1 and 2, an apparatus for wrapping a load with packaging material is generally designated by the reference numeral 100 and includes a packaging material dispenser, means for providing relative rotation between a load and the dispenser, and a packaging material holder.

Figure 1B:
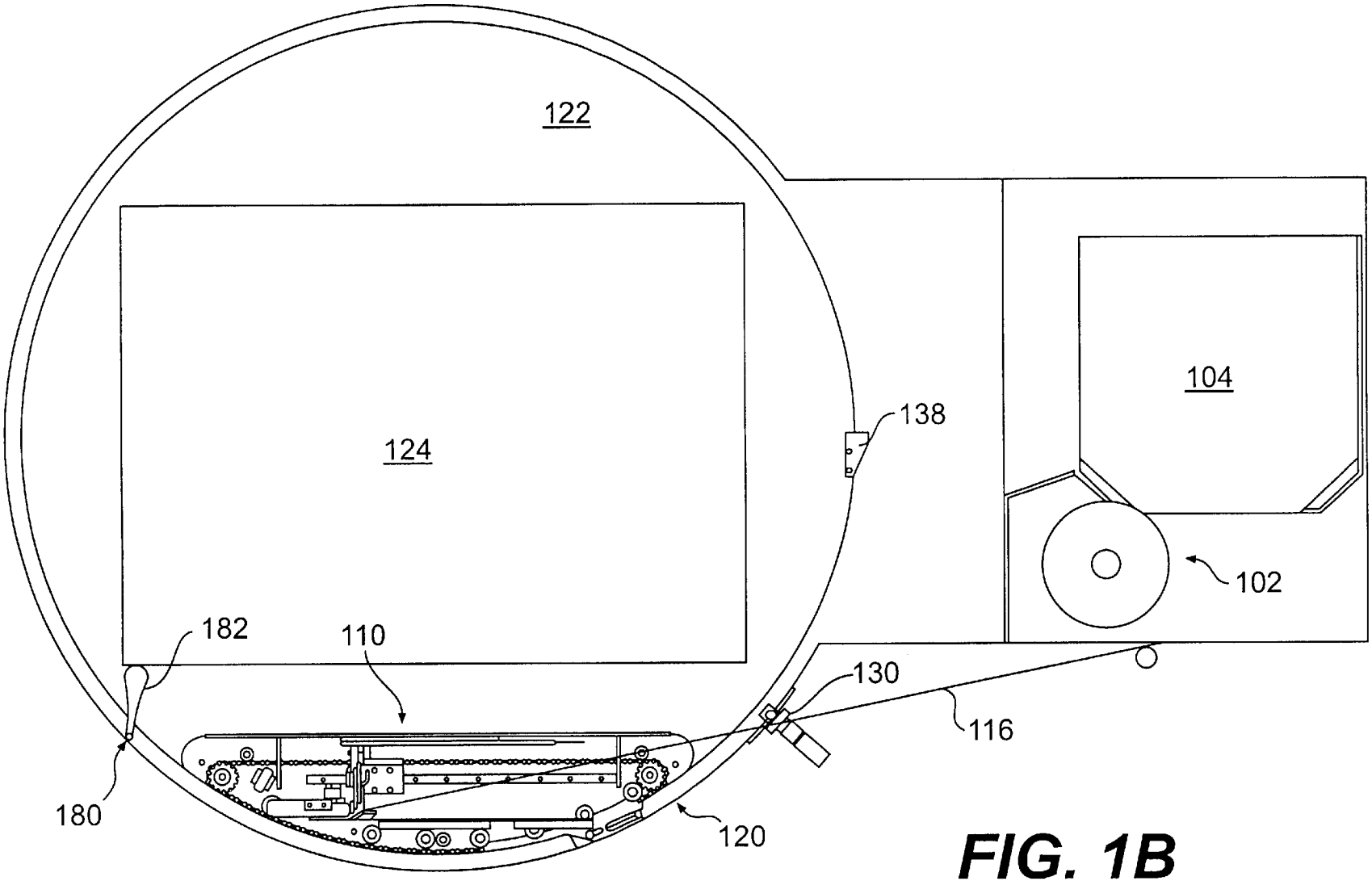
FIG. 1B is a top view of the load wrapping apparatus of FIG. 1A.

As shown in FIGS. 1A and 1B, a dispenser 102 is provided for dispensing packaging material. Packaging material dispenser 102 dispenses a sheet of packaging material 116 in a web form and includes a roll carriage 109 that supports a roll of packaging material 108. Roll carriage 109 of dispenser 102 is mounted on and vertically moveable on a mast 104, shown in FIG. 1A, to dispense packaging material 116 spirally about load 124 as rotation is provided between load 124 and dispenser 102. Roll carriage 109, as embodied herein and shown in FIG. 1A, includes a support for packaging material roll 108 and means for moving on mast 104. Alternatively, roll carriage 109 may include a container for holding packaging material roll 108, and a slit for dispensing packaging material 116 from packaging material roll 108.

In a preferred embodiment, stretch wrap packaging material is used. In the stretch wrapping art, stretch wrap packaging material is known to have a high yield coefficient to allow the material a large amount of stretch during wrapping. Various other packaging materials, generally not considered to be stretch wrap materials, such as netting, strapping, banding, and tape, can be used as well. Dispenser 102 may also include a variety of rollers, optionally including prestretch rollers for stretching the packaging material longitudinally and/or transversely, to position, dispense, and stretch the packaging material as packaging material 116 is being dispensed from the roll of packaging material.

In the invention, apparatus 100 includes means for providing relative rotation between the dispenser and the load to wrap packaging material around the load. As embodied herein and shown in FIGS. 1 and 2, the means for providing relative rotation include a conventional turntable assembly 120 having a rotatable turntable 122. Turntable assembly 120 may be positioned proximate a conveyor to receive a load 124 to be wrapped from a load building area. Load 124 is rotated by rotatable turntable 122 of turntable assembly 120 to provide relative motion between dispenser 102 and load 124.

Although not shown in the drawings, turntable assembly 120 may include an upper conveying surface with a plurality of powered rollers. As an alternative to the turntable embodiment, relative rotation may be accomplished by rotating dispenser 102 around a stationary load.

According to the present invention, a packaging material holder for automatically releasing and grasping portions of the packaging material is provided. As embodied herein and shown in FIGS. 1A–5B, the packaging material holder includes packaging material holder 110, mounted on rotatable turntable 122 of turntable assembly 120, and includes a clamp for grasping, holding, and releasing packaging material 116, and a mechanical movement for actuating the clamp. A means for building and storing energy, and for releasing the stored energy to move the packaging material holder, and a packaging material guard for protecting the clamp of the packaging material holder and for providing a consistently sized graspable tail of packaging material extending from the dispenser are also provided. Additionally, a roper for forming a rope of the packaging material, and a packaging material weakener for weakening the packaging material prior to severing may be provided in this embodiment.

The clamp for holding and releasing packaging material 116, as shown in FIGS. 1–5B, preferably includes opposed surfaces for grasping the packaging material 116, such as jaws 112, 114. Jaws 112, 114 may be made of any suitable material, such as metal or plastic, and in any suitable shape which will allow the jaws to grasp and hold the packaging material without severing it. Jaws 112, 114 are preferably mounted on a rail mounted on the turntable to allow jaws 112, 114 to translate relative to the turntable. Other alternative embodiments of the packaging material holder may include other arrangements such as a single unopposed packaging material engaging surface, such as a sticky or tacky surface for holding the packaging material, or in some instances, a vacuum surface.

As shown in FIGS. 3A–5B, the mechanical movement is mounted on the rotatable turntable and includes a floating cam in the form of a ramp 150 attached to rotatable turntable 122 for supporting the packaging material holder 110 on the turntable assembly 120. The upper surface of ramp 150 forms a downstream pathway 152 at a first height, and the lower surface of ramp 150 from an upstream pathway 154 at a second, lower height. "Upstream" and "downstream," as used herein, are defined in relation to the direction of movement relative to the flow of packaging material from the dispenser 102. Thus, since the packaging material flows from the dispenser, movement toward the dispenser and against the flow of packaging material from the dispenser is defined as "upstream" and movement away from the dispenser and with the flow of packaging material from the dispenser is defined as "downstream." As used herein, the leading end 30 of packaging material 116 is downstream of the trailing end 32 of packaging material 116.

Figure 6:
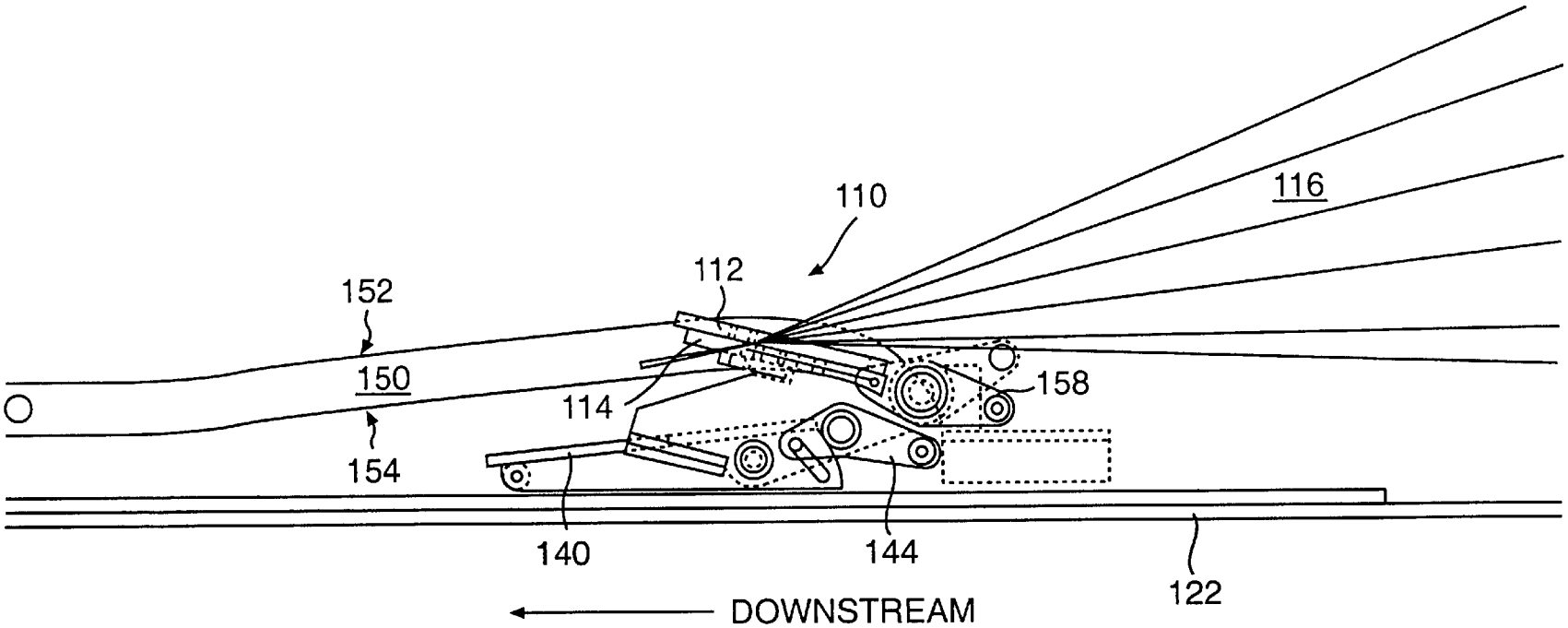
FIGS. 6–12 are schematics showing movement of the packaging material holder during the wrapping process of the present invention.

As embodied herein, the mechanical movement also includes a cam follower 158, which allows jaws 112, 114 to travel on the paths 152, 154 of ramp 150. As shown in FIG. 6, the cam follower 158 is positioned at an upstream end of ramp 150 when holding the packaging material during wrapping. Upon actuation of packaging material holder 110, cam follower 158 moves to the top of the upstream end of ramp 150 and then travels along downstream path 152. Movement of cam follower 158 up onto the upper surface of ramp 150 automatically causes jaws 112, 114 of packaging material holder 110 to open. Jaws 112, 114 remain open as long as cam follower 158 is moving along the downstream path 152 of ramp 150. Once cam follower 158 reaches the end of downstream path 152 of ramp 150, cam follower 158 rolls off of the end of ramp 150. Cam follower 158 rolling off the end of ramp 150 automatically causes jaws 112, 114 to close. As used herein, the term "automatically" is intended to mean that manual assistance is normally not required.

As embodied herein, the mechanical movement includes a cog mechanism 132 that rotates with packaging material holder 110 as turntable 122 rotates. Cog mechanism 132 has an engaging element 134 and a chain element 136. Chain element 136 forms a complete loop, connected at each of its ends to engaging element 134. Chain element 136 engages gears placed along the length of packaging material holder 110, and is moveable along the length of packaging material holder 110. Chain element 136 engages and drives the gears placed along the length of packaging material holder 110, and these gears in turn engage and drive cam follower 158.

Figure 3A:
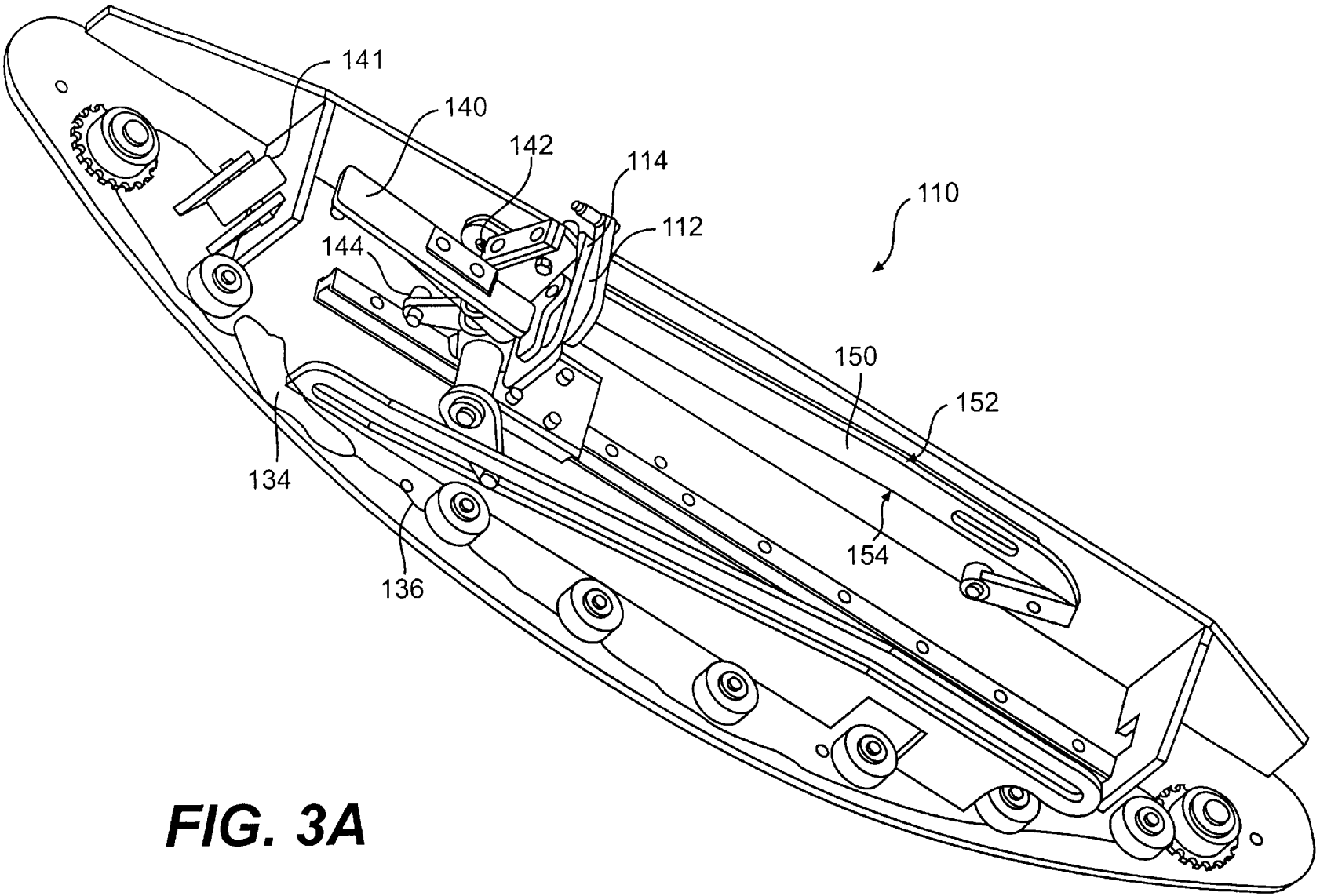
FIG. 3A is a perspective view of the packaging material holder of the present invention.
Figure 3B:
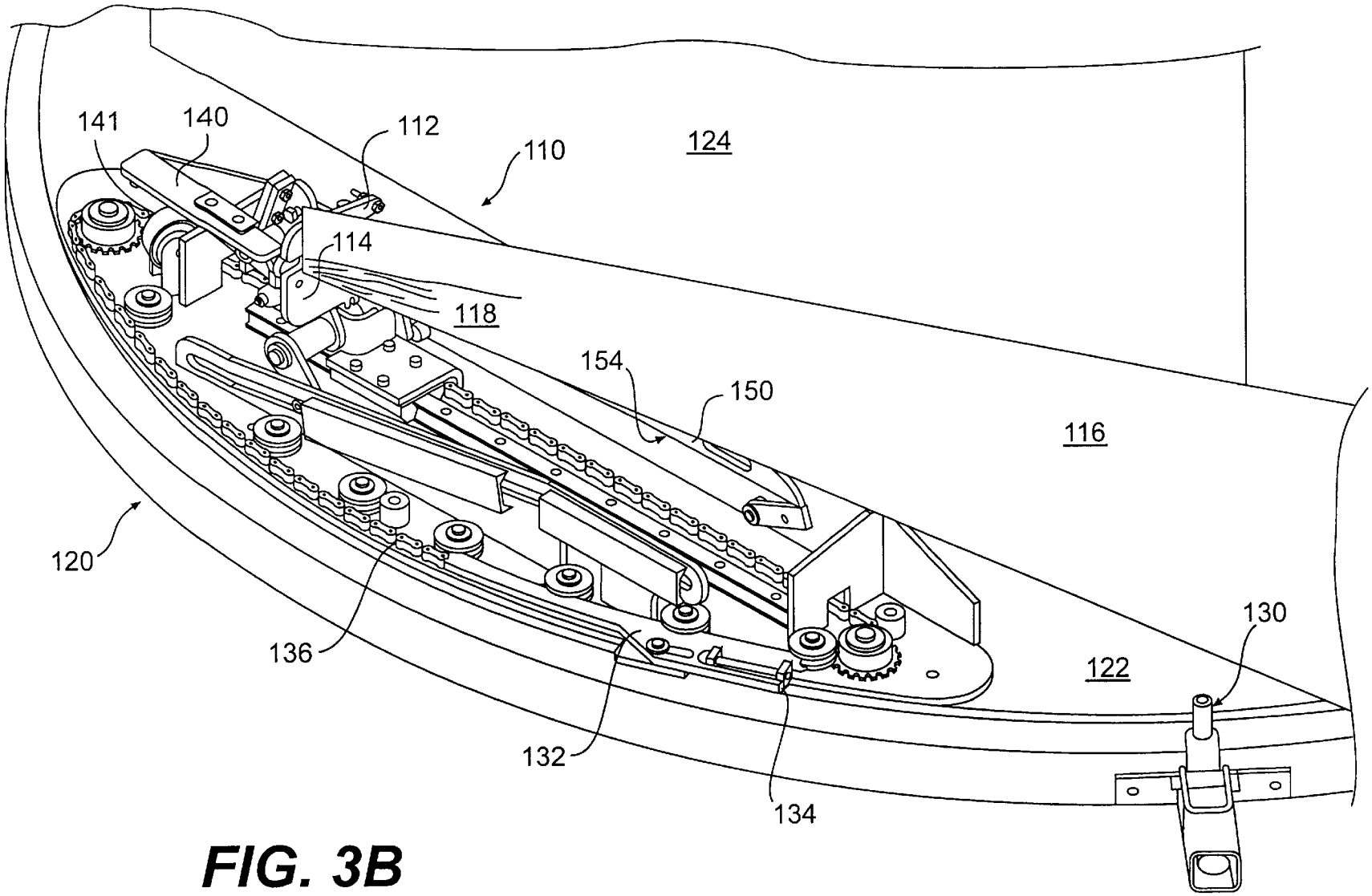
FIG. 3B is a perspective view of the packaging material holder of FIG. 3A mounted on a turntable.
Figure 3C:
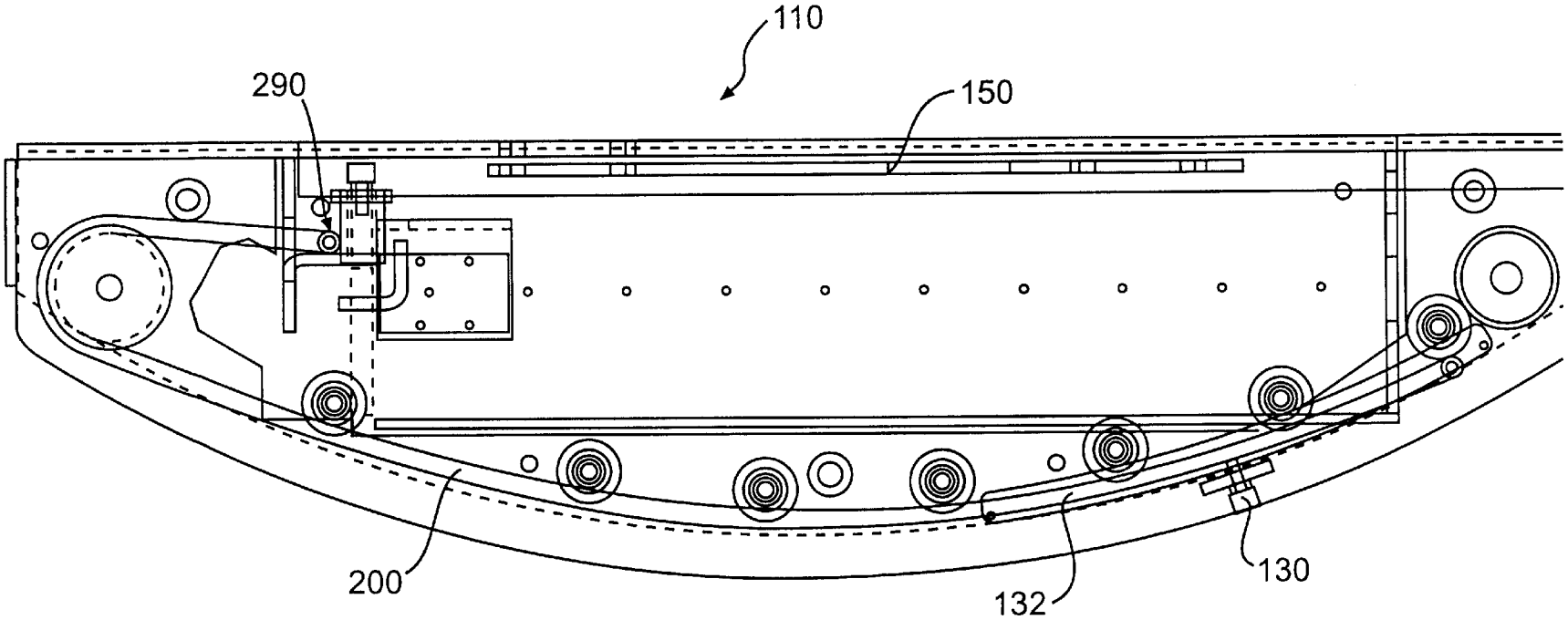
FIG. 3C is a top view of the packaging material holder of FIG. 3A.
Figure 3D:
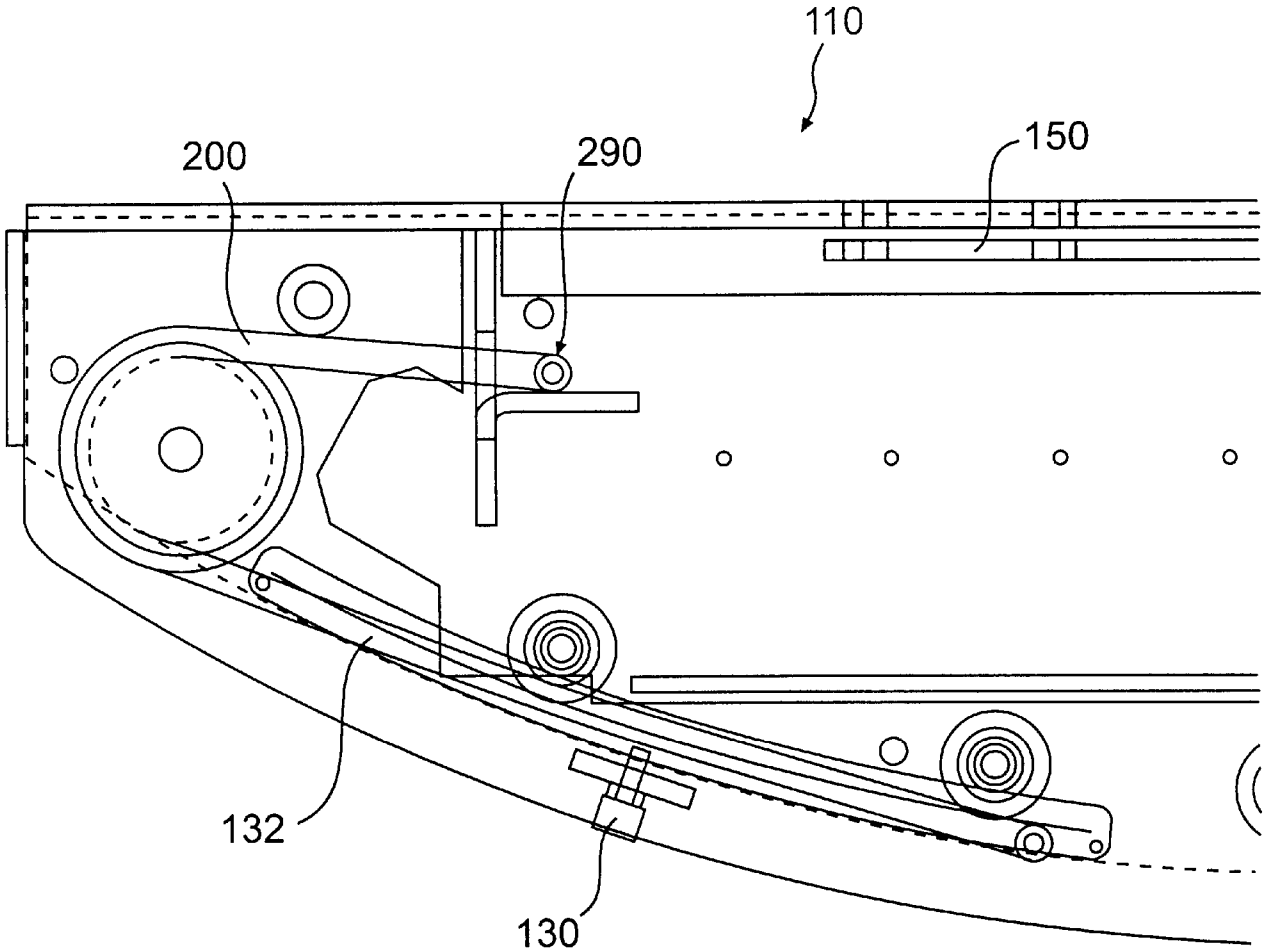
FIG. 3D is an enlarged fragmentary perspective view of the packaging material holder shown in FIG. 3C.
Figure 4A:
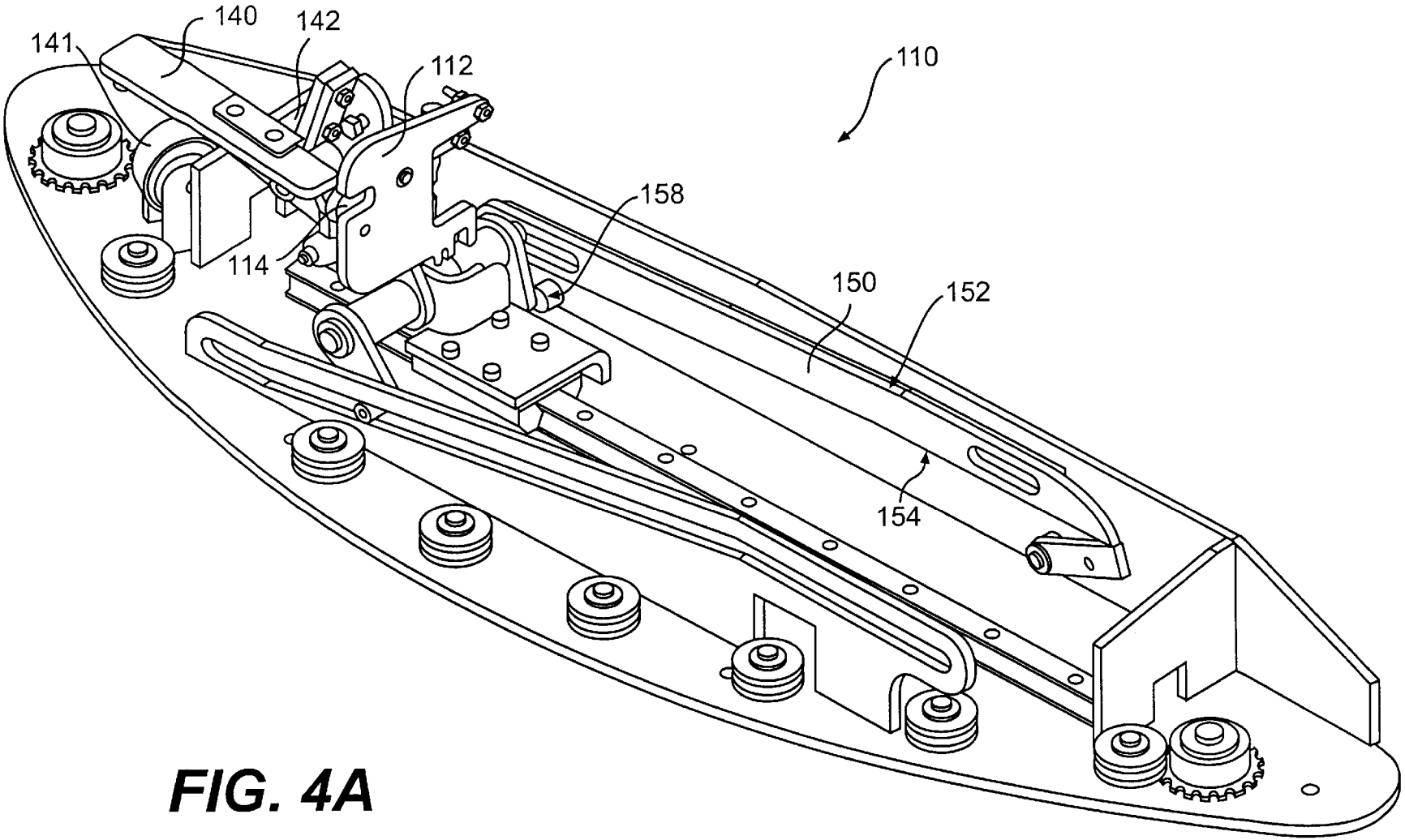
FIG. 4A is a perspective view showing the packaging material holder of FIG. 3 from an opposite side.
Figure 4B:
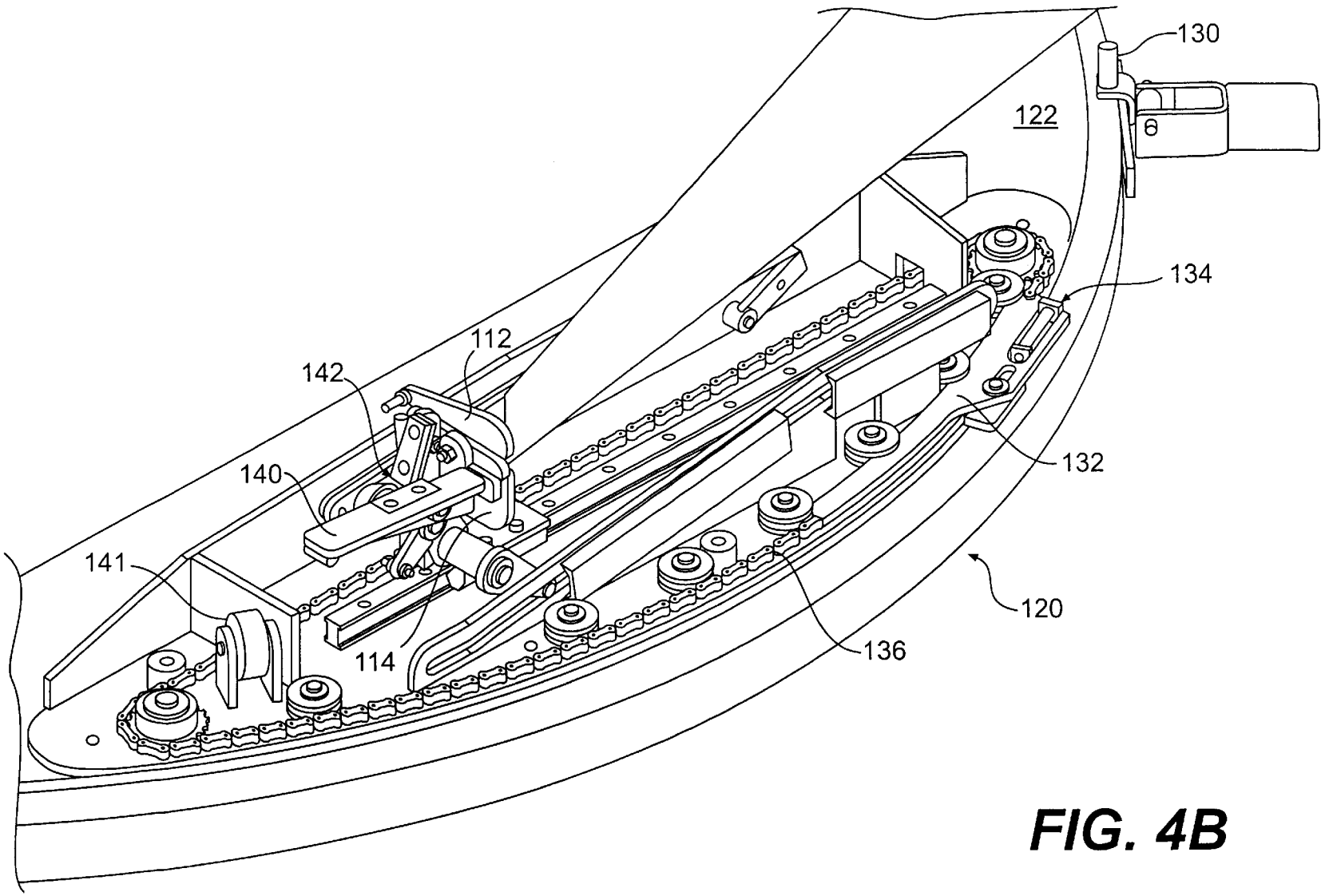
FIG. 4B is a perspective view of the packaging material holder of FIG. 4A mounted on a turntable.

As shown in FIGS. 3C and 3D, the packaging material holder also includes means for building and storing energy in the packaging material holder 110, and for releasing the stored energy to move the packaging material holder 110. As embodied herein, the means for building and storing energy in the packaging material holder 110, and for releasing the stored energy to move the packaging material holder 110 preferably includes a spring 200. Generally, spring 200 has two different states, an unloaded "at rest" state, and a loaded state. The spring is moveable between the unloaded state and the loaded state by moving the spring through the extent of its range of motion, either expanding or contracting, dependent upon the type of spring used. When spring 200 goes from the unloaded state to the loaded state, it is "loading" or "being loaded," and when spring 200 goes from the loaded state to the unloaded state, it is "unloading" or "being unloaded." Spring 200 builds up and stores energy as it is being loaded, and spring 200 releases the stored energy as it is being unloaded. Spring 200 builds and stores the energy as it is moved in a first direction (loading), and releases the stored energy as it moves in an opposite direction (unloading). For example, if spring 200 comprises a compressible spring, the unloaded state of spring 200 would be an uncompressed state, and the spring would be loaded as it is being compressed throughout a range of motion, building and storing energy as it is compressed; the spring would be in a loaded state once it is compressed; and the spring would be unloading as it is decompressing throughout the same range of motion, releasing the stored energy as it is decompressed. While it is generally expected that the spring 200 will move throughout its entire range of motion, until, for example, it cannot be expanded or compressed any further, it is not necessary that it move through its complete range of motion. At any point as it is being loaded, the spring 200 has some stored energy. The spring will only remain in the loaded state so long as it is being physically constrained to remain in such a state. Once the spring is no longer constrained to remain in the loaded state, it will release the stored energy in order to return to its unloaded state.

Spring 200 is connected at one end to cog mechanism 132, and at a second end to a non-movable frame portion 290 of the packaging material holder 110. Spring 200 moves with cog mechanism 132, such that it builds up and stores energy (i.e., it is being loaded) as cog mechanism 132 moves in one direction, and releases the stored energy (unloads) as cog mechanism 132 moves in the opposite direction. Although the means for building and storing energy, and for releasing the stored energy preferably includes a spring, alternatively, the means for building and storing energy, and for releasing the stored energy may include various equivalent structures, such as an elastomeric material, a retractor, a gas shock, or other types of springs such as coil spring or tape spring. Any element which is moveable between two points, which builds and stores energy as it moves in a first direction between the two points, and which releases the stored energy as it moves in an opposite direction between the two points may act as the means for building and storing energy, and for releasing the stored energy.

Although the spring 200 is preferably connected to the cog mechanism 132, it is also possible to directly connect spring 200 to the moveable clamp portion of the packaging material holder 110. In such an embodiment, it is possible that the spring would load and unload based upon the movement of the clamp. Alternatively, if the spring is an element such as a retractor, which extends and then retracts to its original position, the retractor could actually move the clamp between upstream and downstream positions.

Figure 9:
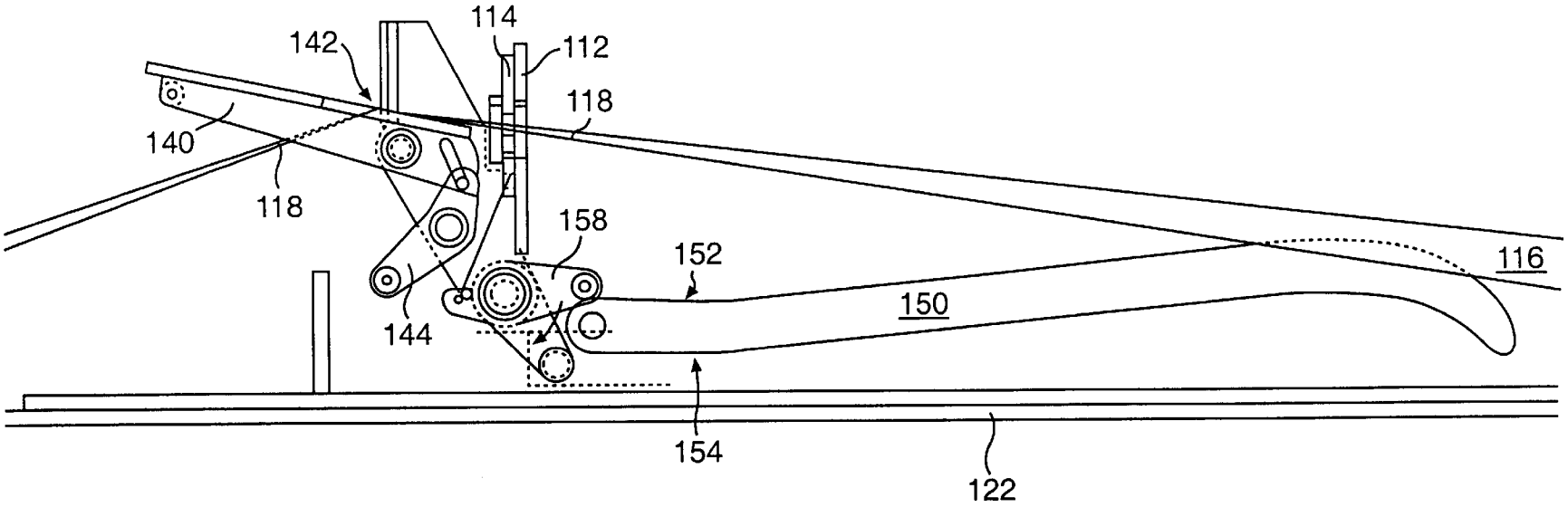
Figure 10:
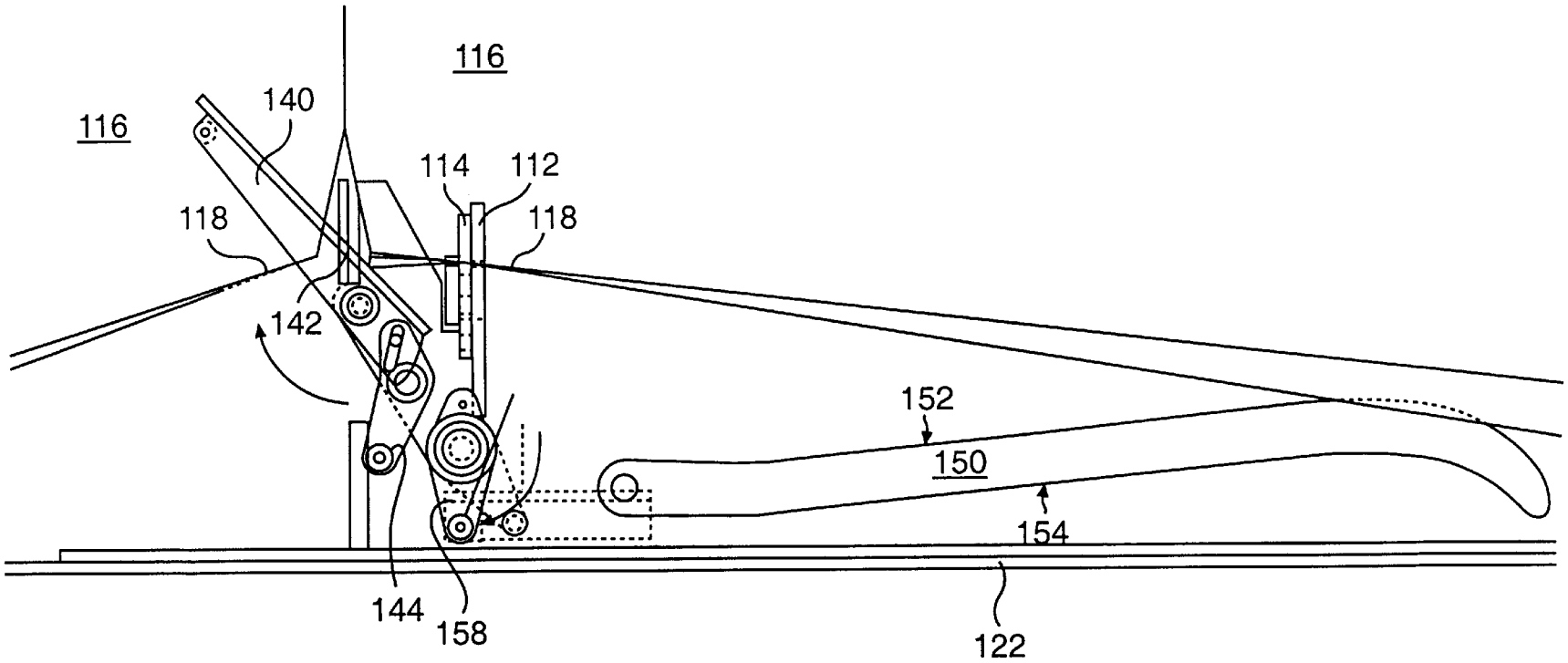
Figure 11:
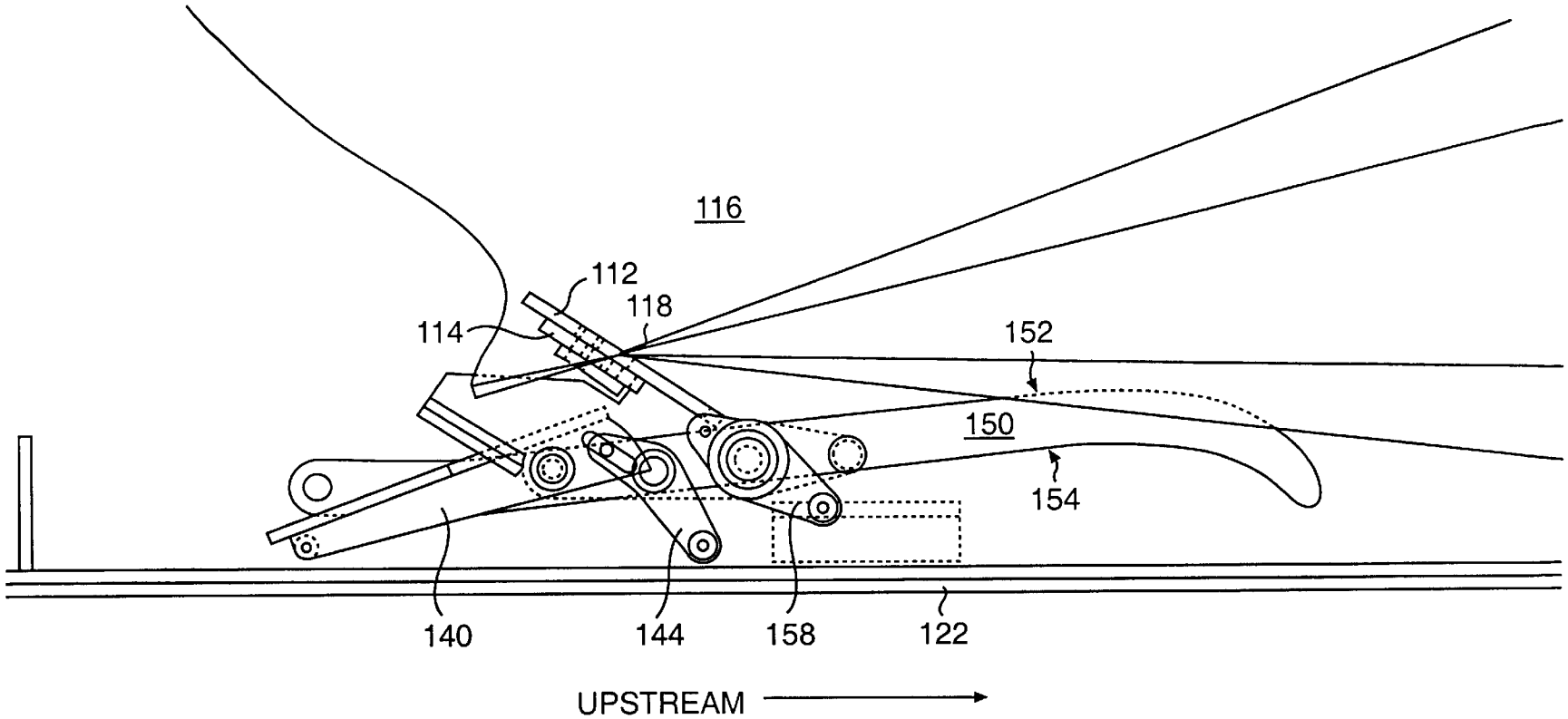
Figure 12:
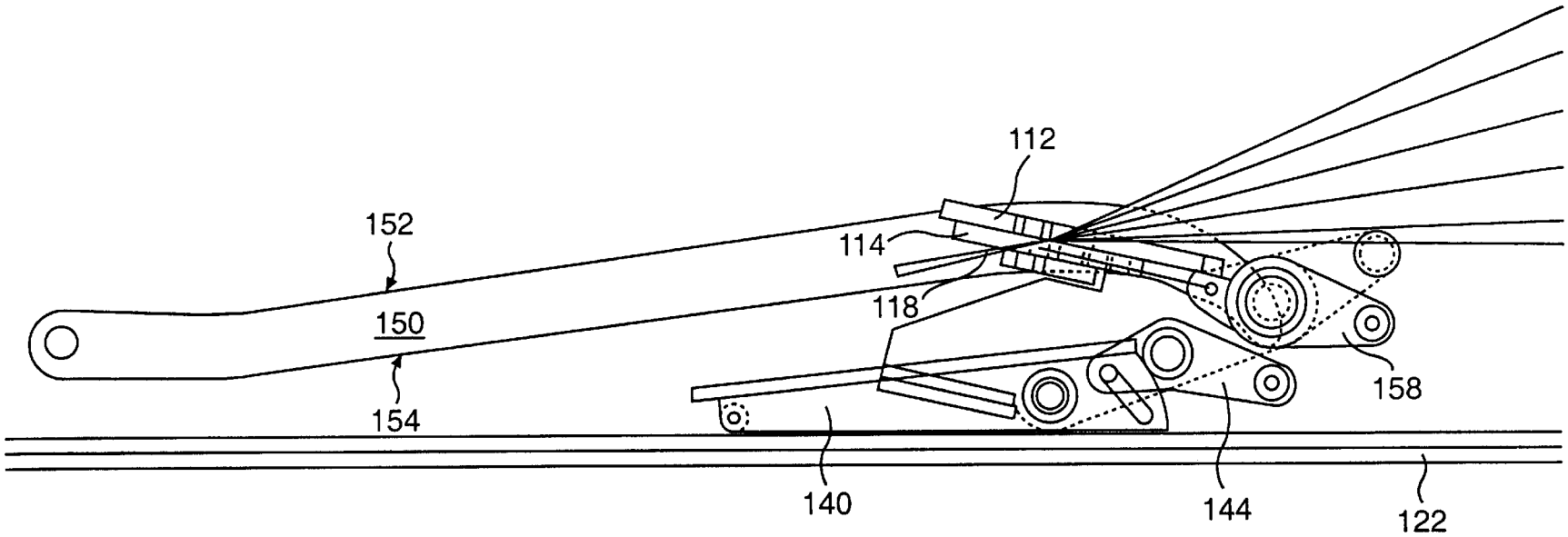

In the preferred embodiment, as described herein the spring 200 will move the packaging material holder toward the dispenser as it releases the stored energy, to a reset position. A reset position is defined as the upstream position of the packaging material holder, the usual position prior to wrapping a new load, where the packaging material holder is holding a leading end of the packaging material. In such a case, the building and storing energy may move the packaging material holder downstream, to a fully extended position. However, the converse is also possible, that is, that the spring will move the packaging material holder away from the dispenser as it releases stored energy, to a fully extended position. The fully extended position is the downstream position of the packaging material holder, where the packaging material holder has traveled along downstream path 152 to the end of downstream path 152, but prior to moving off of the upper surface of ramp 150. In this position, the clamp of the packaging material holder has moved to an upright position where a portion of the packaging material holder rises above the ramp 150 to engage the packaging material (see FIG. 9) and is prepared to or is cutting a portion of the packaging material. In this case, the building and storing energy may move the packaging material holder to the reset position.

As embodied herein, an actuator for the mechanical movement is provided. Preferably, the actuator is positioned apart from rotatable turntable 122 and the mechanical movement, so that the actuator does not rotate with rotatable turntable 122. As shown, the actuator includes a pin 130. Engaging element 134 engages and is driven by pin 130 attached to the non-rotating portion of turntable assembly 120. Pin 130 is moveable between a non-upright position and an upright position, and pin 130 is may be actuated to move to the upright position by a controller. In the upright position, pin 130 engages engaging element 134 of cog mechanism 132 as cog mechanism 132 rotates with rotatable turntable 122, driving cog mechanism 132 in a direction opposite to that of the rotation. As cog mechanism 132 is driven along the length of ramp 150 of packaging material holder 110, the end of spring 200 connected to cog mechanism 132 moves with cog mechanism 132. Spring 200 is positioned with respect to cog mechanism 132 such that spring 200 is loaded and energy is built up in spring 200 as it moves with cog mechanism 132 when cog mechanism 132 is moving in a direction opposite that of the rotation of the turntable. Dependent upon the type of spring used, spring 200 may either expand or contract as cog mechanism 132 moves. As cog mechanism 132 is driven along the length of ramp 150 of packaging material holder 110, cam follower 158 is driven along the length of ramp 150 in the opposite direction, along downstream path 152. Jaws 112, 114 of packaging material holder 110 move with cam follower 158 along the downstream path 152.

Cog mechanism 132 also includes a release element 138 attached to rotatable surface 122 of turntable 120. Release element 138 is positioned at the upstream end of packaging material holder 110. Release element 138 is positioned to knock down or disengage pin 130 from cog mechanism 132 once cog mechanism 132 has moved from the downstream end of packaging material holder 110 to the upstream end of packaging material holder 110. As the length of packaging material holder 110 preferably defines the full range of movement for cog mechanism 132 and spring 200, it is necessary to release cog mechanism 132 and spring 200 once they have reached the end of their range of motion. Release element 138 serves this purpose by releasing pin 130 which was driving cog mechanism 132 and spring 200. Once pin 130 is released, the energy stored in spring 200 is released, and spring 200 unloads, either by contracting or expanding to its original unloaded state, moving back to its original position and moving in a direction opposite to the one in which it was driven by cog mechanism 132 and pin 130. As spring 200 returns to its unloaded state, it causes cog mechanism 132 to move with it.

Jaws 112, 114 of packaging material holder 110 reach the end of downstream path 152 (the fully extended position) as cog mechanism 132 reaches the end of its range of motion. Jaws 112, 114 move off the end of downstream path 152, and then move along upstream path 154 after they have reached the end of downstream path 152. Cam follower 158 is moved along upstream path 154 by two separate forces: (1) cam follower 158 is pulled along upstream path 154 by the force exerted upon packaging material 116 held in jaws 112, 114 by the roll of packaging material in dispenser 102; and (2) cam follower 158 is driven along the upstream path by the release of the energy in spring 200 as spring 200 unloads to return to its unloaded state. As spring 200 returns to its unloaded state, it moves cog mechanism 132 with it, and chain element 136 of cog mechanism 132 engages and drives the gears placed along the length of packaging material holder 110, and these gears in turn engage and drive cam follower 158, causing it to move along upstream path 154, returning the packaging material holder to the reset position. As shown in FIGS. 3–5B, downstream path 152 is positioned above upstream path 154, such that packaging material holder 110 travels at a first level downstream, and at a second, lower level upstream.

As discussed above, packaging material holder 110 is mounted on the top surface of rotatable turntable 122, and jaws 112, 114 of packaging material holder 110 are actuated to automatically open and close at predetermined points along the length of ramp 150 of packaging material holder 110. As embodied herein, packaging material holder 110 is isolated from any electrical or fluid source of power by the turntable, in contrast to conventional devices in which the packaging material holder is connected to an electrical or fluid source of power by the turntable such as by a power connection through the journal of the turntable to the packaging material holder. This means that the packaging material holder also does not receive any electrical or fluid power from brushes, or the like, around a circumference of the turntable. The rotatable turntable 122 therefore does not carry electrical or fluid power sources with it during rotation and acts as a barrier between the packaging material holder and any electrical or fluid source of power.

This enables the present invention to take advantage of the changing of the angle of the packaging material relative to the load (or to a distal portion of a packaging material holder guard, to be discussed below) as the turntable rotates. The rotation of the turntable is harnessed to linearly move the packaging material holder along the turntable surface. During the last rotation of the turntable, as the angle becomes smaller and the packaging material approaches the side of the load (or the guard), the packaging material holder is driven by the rotation of the turntable into a position to engage the trailing end of the packaging material.

Figure 2:
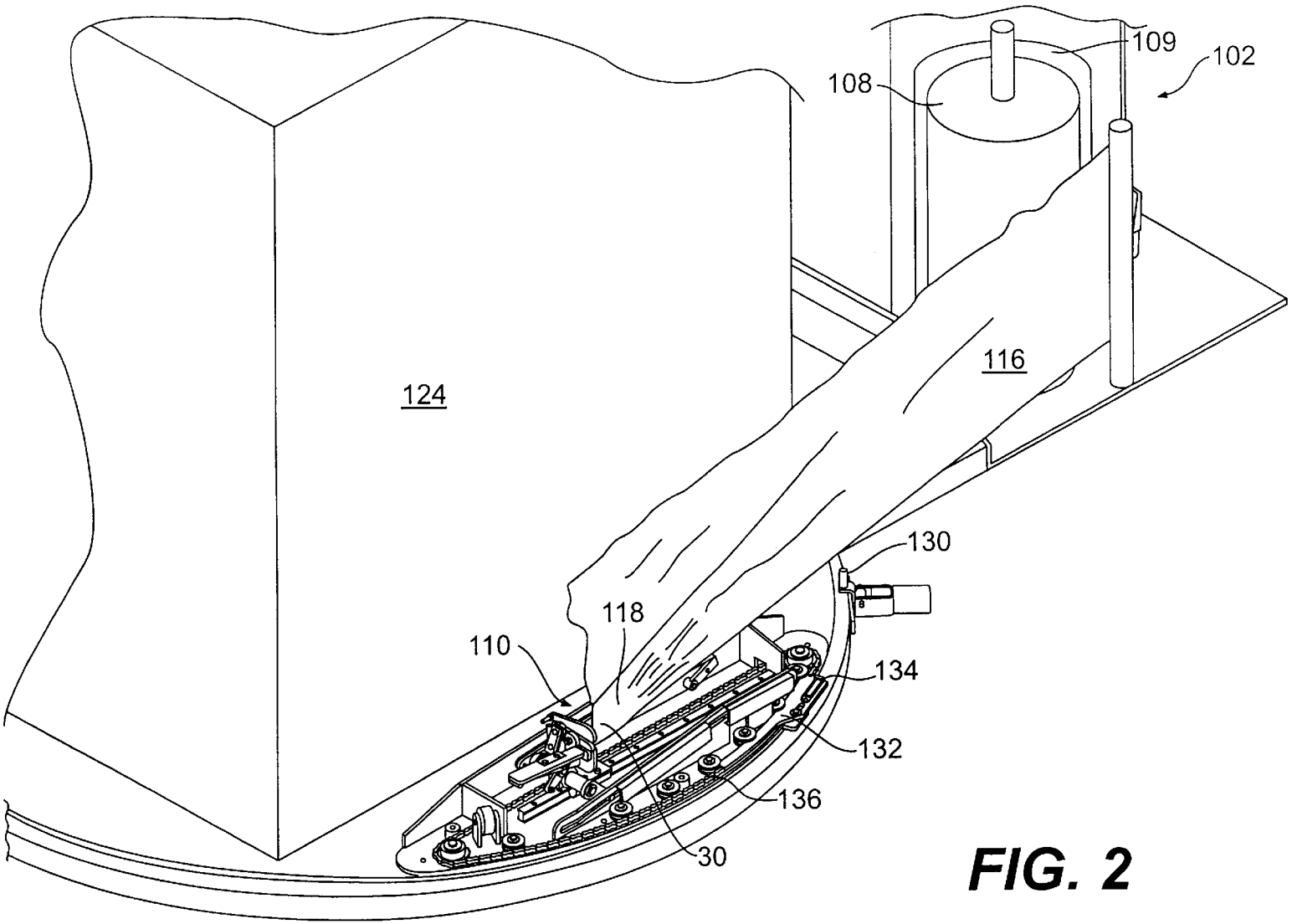
FIG. 2 is an enlarged fragmentary perspective view of apparatus shown in FIG. 1.

In a preferred embodiment, as shown in FIG. 2, the movement of the turntable is utilized to move jaws 112, 114, opening and closing jaws 112,114 to automatically release and grasp, respectively, packaging material 116. As discussed above, cog mechanism 132 cooperates with pin 130 to move jaws 112,114 relative to rotatable turntable 122 and thereby open and close jaws 112, 114. Pin 130 can be actuated to move from the non-upright position to the upright position at a predetermined point in the wrapping cycle by the controller. Preferably, pin 130 is actuated during the last rotation in the wrapping cycle, and most preferably during the last quarter turn of the wrapping cycle, to engage cog mechanism 132. Because cog mechanism 132 moves with rotatable surface 122 of turntable 120, the rotation of the turntable can be used to move cog mechanism 132. Cog mechanism 132 is moveably connected to jaws 112, 114 such that, if cog mechanism 132 moves to the left, jaws 112, 114 will move to the right. Alternatively, if cog mechanism 132 is moved to the right, jaws 112, 114 will move to the left. Thus, it is the rotation of the turntable, rather than an electrical or fluid power source carried by the rotating turntable, that is used to move and thereby automatically open and close jaws 112, 114.

Other mechanical movements including various combinations of mechanical or electrical devices may be used to cause movement and opening and closing of jaws 112, 114. Alternatively, turntable 122 may not rotate while the packaging material is automatically released and grasped by the packaging material holder. In such a situation, packaging material holder 110 could be powered by a separate power source such as a motor placed on the floor or near the turntable.

Figure 5A:
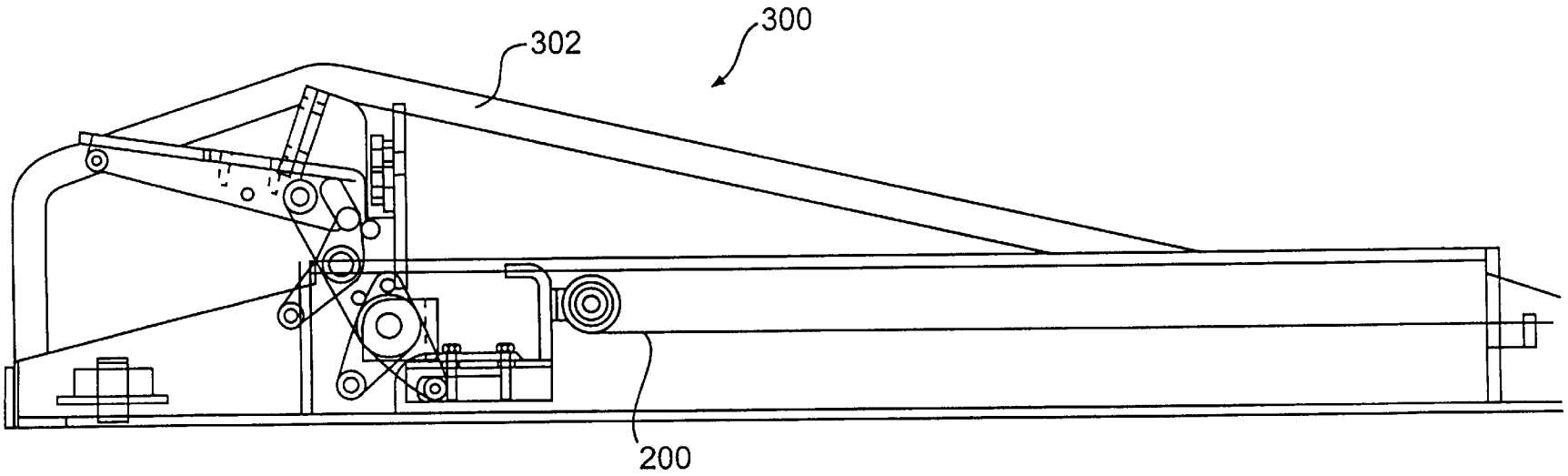
FIG. 5A is a side view of a second embodiment of the packaging material holder of the present invention.
Figure 5B:
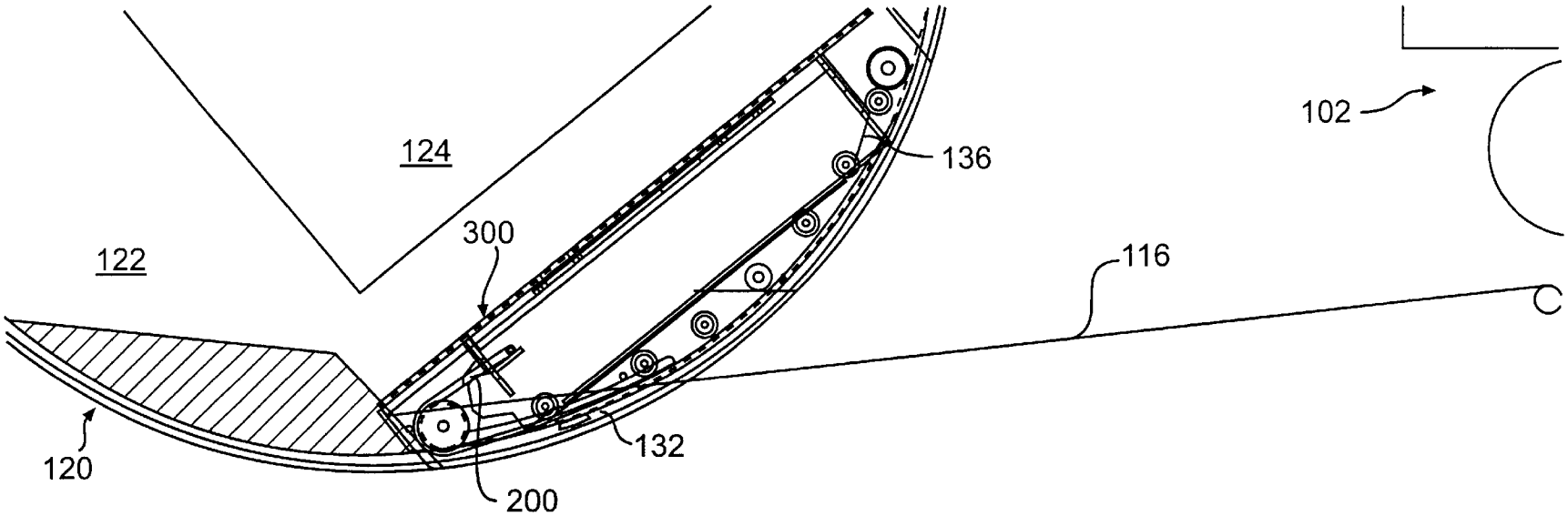
FIG. 5B is a top view of the packaging material holder of FIG. 5A mounted on a turntable.

According to one aspect of the invention, a guard for protecting the clamp of the packaging material holder may be provided. As shown in FIGS. 5A and 5B, and as embodied herein, guard 300 is positioned on the turntable 120. Guard 300 separates the portion of the turntable 122 supporting packaging material holder 110 from the remainder of the turntable surface 122 which forms a load support surface for supporting the load 124 during wrapping.

In a preferred embodiment, guard 300 includes an extended backstop portion 302, which extends along the entire length of packaging material holder 110. Backstop 302 is shaped to follow the path of the clamp for holding and releasing the packaging material. As the clamp, usually jaws 112, 114, translates relative to the turntable to move jaws 112, 114 downstream, the clamp moves vertically as well as horizontally, forming a path of movement resembling a squared sine wave. In order to protect the clamp, backstop 302 is shaped to follow the path of movement of the clamp, and has a shape resembling a squared sine wave. Backstop 302, also extends above the path of movement of the clamp, such that along any portion of the length of the packaging material holder, the backstop 302 is the highest point of the packaging material holder. Preferably, backstop 302 extends two inches above the path of movement of the clamp, along the entire path of movement of the clamp. The distance backstop 302 extends above the path of movement of the clamp may vary due to the design of a particular packaging material holder, extending more or less than two inches above the path of the clamp. Additionally, the shape of backstop 302 may also vary, so long as the backstop is of such a size and shape as to always remain between the load being wrapped and the clamp of the packaging material holder, even when the clamp is in its full upright position. The backstop 302 should always extend above the path of the clamp.

Backstop 302 includes an upper rolled metal portion, and a lower sheet metal portion. The upper rolled metal portion forms an outline of the clamp path, rising upward from the turntable, extending along the length of the packaging material holder 110 at a height greater than the path followed by the clamp, and extending downward to return to the turntable. The upper rolled metal portion forms two corners or end portions of the backstop 302, at either end of the clamp path. Rolled metal is used in the upper rolled metal portion because it allows packaging material to pass easily over the backstop 302 during the wrapping process. The lower sheet metal portion is attached to the rolled metal outline of the clamp path and fills in the interior space defined by the outline to create a solid backstop 302. The lower sheet metal portion is intended to protect the packaging material holder from loading equipment when a load is being placed on or removed from the load support surface of the turntable. For example, it is common to use forklift trucks to place loads onto the turntable prior to wrapping. The lower sheet metal portion prevents the prongs of the forklift truck from inadvertently coming into contact with and damaging the packaging material holder 110.

The two corners or end portions of the backstop are referred to as the proximal and distal corners of the guard (proximal and distal end portions of the guard), with respect to the packaging material dispenser. The distal corner or portion of the guard provides a consistent framework for assisting in breaking the packaging material after the load has been wrapped. In prior art devices, it is necessary to position the load to be wrapped within a certain zone on the turntable in order to ensure that the packaging material will properly contact the corners of the load to form a workable film path between the dispenser and the load, at an angle which will allow the clamp of the packaging material holder to intercept the packaging material. For example, prior to the present invention, it was necessary that a corner of a load to be wrapped be placed in the shaded area of the turntable as shown in FIG. 5B. With the corner of the load placed in the shaded area, it could be assured that as the turntable rotated, the angle of the film path of the packaging material will intercept the clamp of the packaging material holder.

With the present invention, the packaging material intercepting the distal corner or portion of the guard, and not the corner of the load, determines the angle of the film path. This eliminates worries about positioning the corner of the load, and it also provides a consistent angle of the film from the distal corner of the guard to where the film is eventually cut between the load and the dispenser. This consistent angle results in a uniformly sized graspable tail of packaging material extending from the dispenser after each wrapping cycle.

According to one aspect of the invention, a roper may be provided for forming a rope of packaging material. As discussed herein, "roping" packaging material means rolling or twisting or collapsing a portion of the web of packaging material 116 to shape it into a rope-like form. In order to withstand a starting force during wrapping, at least 20% of the web of packaging material 116 should be held by the packaging material holder. For example, a web of packaging material twenty (20) inches high may have a five (5) or six (6) inch portion formed into a rope. This allows the jaws 112, 114 to engage a rope 118 and a portion of the web of packaging material 116, rather than holding only a small portion of the packaging material 116 between the opposing surfaces. As seen in FIGS. 1 and 2, jaws 112, 114 can grasp a substantial cross section of the web of packaging material 116 when it has been roped. This gives the lower portion of the web of packaging material 116 between jaws 112, 114 and dispenser 102 the triangular shape seen in FIGS. 1 and 2. As embodied herein and shown in FIG. 4, the roper includes scooping element 140, which is attached to and moveable with jaws 112, 114 of packaging material holder 110. As jaws 112, 114 and scooping element 140 move along downstream path 152, they move from a flat position to an upright position. As scooping element 140 changes position, it captures the web of packaging material 116 and rolls the packaging material 116 into a rope 118 as it moves into the full upright position (the fully extended position).

Although the present invention, as embodied herein, uses a scoop for roping, it is possible to use a wheel to roll the lower edge of the packaging material upward to form a rope of packaging material or to use a combination of a scoop and a wheel. Alternatively, other means such as a ramp may be used to gather the packaging material together to form a rope. Additionally, although it is preferable to rope only a portion of the web of packaging material, it is possible to rope the entire web of packaging material to form a single rope of packaging material.

A positioner may be provided for passing the packaging material over the packaging material holder during wrapping. As embodied herein and shown in FIGS. 3 and 4, the positioner for passing the packaging material over packaging material holder includes wheel 141. Wheel 141 rolls a lower edge of packaging material 116 as it passes over wheel 141, lifting it above packaging material holder 110. Thus it causes packaging material 116 to pass above packaging material holder 110, avoiding the tenting effect of holders in the prior art.

As embodied herein and shown in FIG. 3, a packaging material weakener is provided for weakening the packaging material 116 between the load 124 and the dispenser 102. The packaging material holder 110 preferably includes a cutter 142. Cutter 142 may include an opposed cutting element, such as scissors, or a single cutting element such as a razor blade. Cutter 142 is connected to an actuation lever 144 which moves with jaws 112,114. Actuation lever 144 is moveable between a free position and a contact position. As jaws 112,114 move along downstream path 152, jaws 112, 114 open, automatically releasing packaging material 116, scooping element 140 moves upward to scoop the lower edge of the web of packaging material 116 into a rope 118, and actuator lever 144 moves from the free position to the contact position. When actuation lever 144 is in the contact position, cutter 142 is activated to weaken packaging material 116 by cutting at least a portion of the web of packaging material 116, including the rope 118 of packaging material 116. It is also possible that cutter 142 may cut the entire web of packaging material 116, including the rope 118, to sever the packaging material. As used herein, to sever the packaging material means to separate it into two portions, cutting through the entire width of the packaging material.

Alternatively, cutter 142 may include a separately actuated device, such as a hot wire receiving power from a ground source. In such an embodiment, cutter 142 may cut through a portion of the web of packaging material, including the rope 118, to weaken the packaging material, or cutter 142 may cut through the entire web of packaging material 116, to sever the packaging material. Alternatively, cutter 142 might cut through the entire web of packaging material if the entire web of the packaging material 116 has been roped to form a single rope 118 of packaging material.

According to one aspect of the present invention, the apparatus may include means for securing a trailing end of packaging material to the load. As embodied herein, the means for securing includes a film wipedown mechanism for wiping a film tail onto the load after the packaging material has been cut. As shown in FIG. 1, the film wipedown mechanism 180 includes wipe loops 182 and a wipe arm 184. This allows a film tail to be wiped onto load 124 as the packaging material 116 is cut.

Other cutters and wipedown arrangements may also be used.

A method for wrapping a load according to the present invention is shown in FIGS. 6–12. As shown in FIGS. 1A and 5A and according to a preferred embodiment of the present invention, a load 124 is conveyed by a conveyor 118 or a by a forklift truck to a turntable assembly 120 in the wrapping station and load 124 is positioned on a load support surface portion of rotatable turntable 122 of turntable assembly 120 and near packaging material guard 300. The clamp of packaging material holder 110 is protected from a forklift truck by backstop 302 of packaging material guard 300. Jaws 112, 114 of packaging material holder 110 hold a leading end portion 30 of a roped sheet of packaging material 116, preferably stretch wrap packaging material. Cog mechanism 132 is positioned at a downstream end of packaging material holder 110, spring 200 is in its unloaded state, jaws 112, 114 are positioned at the upstream end of packaging material holder 110 in the reset position, and cam follower 158 is positioned to the upstream side of ramp 150 (FIG. 6).

Rotatable turntable 122 begins to rotate and packaging material 116 is dispensed from dispenser 102 about load 124. As packaging material 116 passes over packaging material holder 110, wheel 41 engages the lower edge of the packaging material, ensuring that the packaging material does not become caught on any part of the packaging material holder, but rather passes over packaging material holder 110 and backstop 302 of guard 300. This avoids a "tenting" effect and allows tight wrapping of the load. Preferably, the packaging material dispenser from dispenser 102 travels from the dispenser 102 to the distal corner of backstop 302, and from the distal corner of backstop 302 to the load 124. Load 124 is spirally wrapped with packaging material 116 as dispenser 102 moves vertically along mast 104 as the relative rotation is provided.

Figure 7:
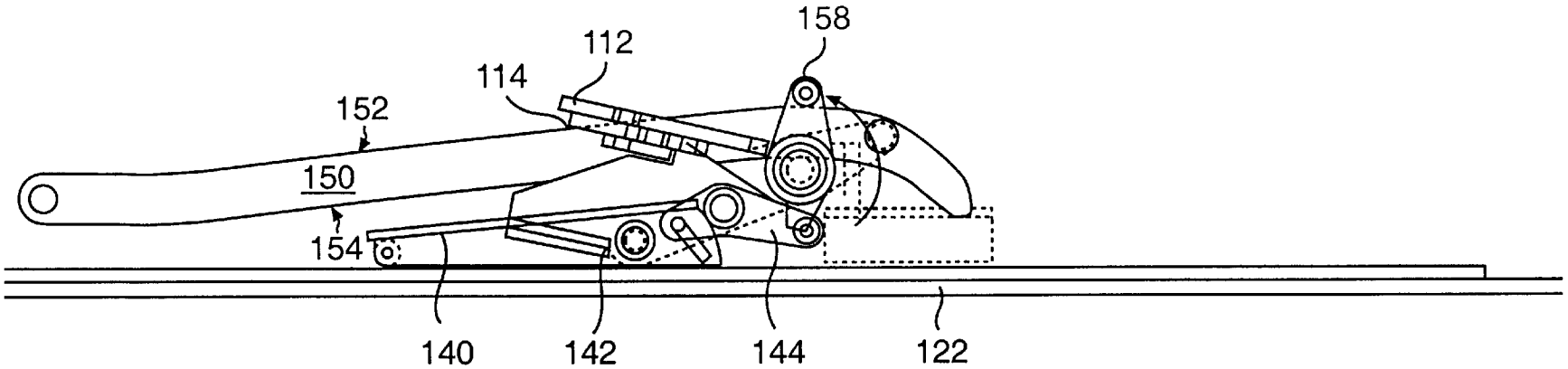
Figure 8:
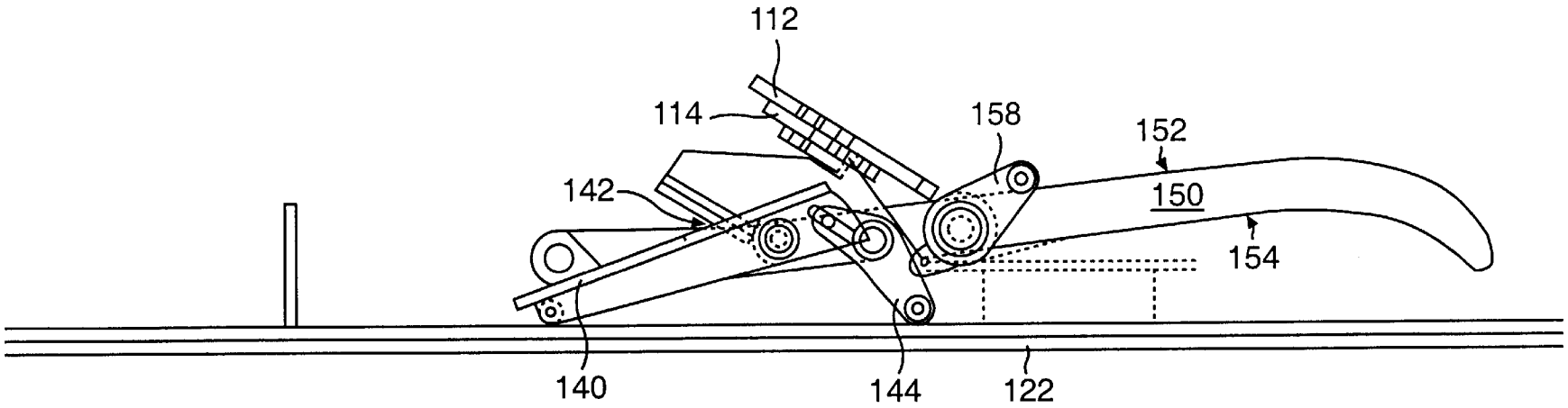

As the load is wrapped and rotatable turntable 122 enters the last rotation of the wrapping cycle, see FIG. 7, a pin 130 attached to a non-rotating portion of turntable assembly 120 is actuated by the controller, moving from a non-upright position to an upright position. As the turntable 122 rotates, pin 130 engages engaging element 134 of cog mechanism 132, located on top of rotatable turntable 122 of turntable assembly 120. Pin 130 causes cog mechanism 132 to move upstream (in a direction opposite to that of the rotation) along the top surface of rotatable turntable 122 of turntable assembly 120 as rotation continues. As cog mechanism 132 moves upstream, it begins loading spring 200. Spring 200 builds and stores energy as it is loaded and moves with cog mechanism 132 as cog mechanism 132 moves upstream.

As cog mechanism 132 moves, the movement causes cam follower 158 to move up onto the top of ramp 150, to the start of downstream path 152. When cam follower 158 moves to the top of ramp 150, jaws 112, 114 open, automatically releasing leading end portion 30 of packaging material 116 (see FIG. 8). Additionally, dispenser 102 may be shut off to tension the film between load 124 and dispenser 102. Preferably, the packaging material is tensioned between the distal portion of backstop 302 and the dispenser.

As cog mechanism 132 moves, it drives jaws 112, 114 downstream along a downstream path 152 of ramp 150. As spring 200 continues moving with cog mechanism 132, it continues building and storing energy. Concurrently, scooping element 140 begins to move from a retracted position to an upright position, scooping a trailing end 32 of packaging material 116 into a rope 118. As jaws 112, 114 continue to move downstream, they remain open, receiving trailing end 32 of packaging material 116 formed into rope 118 as scooping element 140 reaches its full upright position (see FIG. 9). As cog mechanism 132 reaches the upstream end of packaging material holder 110, spring 200 preferably reaches the limit of its range of motion, i.e., reaches a fully loaded state, and cam follower 158 reaches the end of path 152 (the fully extended position) and rolls off the end of ramp 150, causing jaws 112,114 to automatically clamp shut on and grasp trailing end 32 of roped packaging material 116.

As scooping element 140 is moving from the retracted position to the full upright position (see FIG. 10), actuation lever 144 moves from the free position to the contact position, activating cutter 142 to cut at least a portion of packaging material 116 between jaws 112, 114 and load 124 after jaws 112, 114 have automatically grasped the trailing end 32 of packaging material 116. At the same time, pin 130 encounters release element 138 at the upstream end of packaging material holder 110, which knocks pin 130 into its non-upright position, causing it to disengage from cog mechanism 132. Alternatively, scooping element may form the entire web of packaging material into a rope 118, and cutter 142 may sever the rope, rather than weakening a portion of the rope.

Once jaws 112, 114 have reached the downstream end of packaging material holder 110, they grasp and hold trailing end 32 of packaging material 116. Packaging material 116 extends between dispenser 102, jaws 112, 114, and load 124. Once cog mechanism 132 is released, spring 200 is no longer physically constrained to remain in the loaded state and it begins unloading, releasing its stored energy to move toward the unloaded state. As spring 200 begins releasing the stored energy, it causes cog mechanism 132 to move back toward the downstream end of packaging material holder 110. As cog mechanism 110 is moved downstream by the release of energy, it in turn causes cam follower 158 to move toward the upstream end of packaging material holder 110 along upstream path 154 of ramp 150. Additionally, the tension in packaging material 116 between dispenser 102 and jaws 112, 114 adds to the tension created by the release of the energy and movement of cog mechanism 132 to move jaws 112, 114 upstream toward the dispenser (see FIG. 11). Jaws 112, 114 move upstream as cam follower 158 travels along upstream path 154 of ramp 150 in response to the force exerted by the packaging material. Because cam follower 158 can travel underneath the floating cam (ramp 150) as it returns upstream toward the reset position, instead of traveling on top of ramp 150, jaws 112, 114 remain shut as they travel upstream. As jaws 112,114 holding trailing end 32 of packaging material 116 move upstream, packaging material 116 is tensioned between jaws 112, 114 and load 124. Because of the relative movement of the packaging material holder, packaging material 116 then breaks at the weakened portion between load 124 and jaws 112, 114, rather than between the packaging material holder and the dispenser. This provides a true automatic operation by maintaining the packaging material to be held in the packaging material holder before, during and after severing.

Other arrangements for permitting the packaging material holder to move upstream with the packaging material toward the dispenser may also be provided.

Although the arrangement illustrated in the drawings weakens and then breaks the packaging material between the load and the jaws, it is in the scope of the one aspect of the invention to weaken the film somewhere between the dispenser and the load, and then break the film between the jaws and the load. Additionally, it is possible to simply sever the packaging material, as opposed to weakening and then breaking the packaging material.

All of the functions can be controlled with a conventional microprocessor, electromechanical controller, or other controller devices which are conventionally used with the stretch wrapping apparatus.

The present invention as embodied herein and described above, allows fully automated wrapping of loads at a drastically reduced cost and in an extremely efficient manner. The simplicity of the apparatus and its function allows existing rotary stretch wrapping apparatus to be retrofit to become fully automated. By using the rotation of the turntable to facilitate the releasing, grasping, and cutting of the packaging material, the need to supply power through the rotatable turntable of the turntable assembly to the packaging material holder and the need for expensive timing circuits is eliminated.

It will be apparent to those skilled in the art that various modifications and variations can be made in the present invention without departing from the spirit or scope of the invention. Thus, it is intended that the present invention covers all modifications and variations of this invention that come within the scope of the appended claims and their equivalents.

What is claimed is:

1. An apparatus for wrapping a load with packaging material, comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including means for building and storing energy through rotation of the turntable, and for releasing the stored energy to move the packaging material holder.

2. The apparatus of claim 1, wherein the means for building and storing energy, and for releasing the stored energy is a spring.

3. The apparatus of claim 1, wherein the means for building and storing energy, and for releasing the stored energy is a spring, and wherein building and storing energy loads the spring.

4. The apparatus of claim 1, wherein the means for building and storing energy, and for releasing the stored energy is a spring, and wherein releasing the stored energy causes the spring to move from a loaded state to an unloaded state.

5. The apparatus of claim 1, wherein the means for building and storing energy, and for releasing the stored energy builds and stores energy during the last rotation of the turntable in a wrapping cycle.

6. The apparatus of claim 1, wherein the means for building and storing energy, and for releasing the stored energy builds and stores energy during the last quarter rotation of the turntable in a wrapping cycle.

7. The apparatus of claim 1, wherein the packaging material holder includes jaws for grasping and releasing the packaging material, and wherein the means for building and storing energy, and for releasing the stored energy is a spring moveably connected to the packaging material holder; and wherein the spring is loaded as the turntable rotates and the jaws move toward the packaging material dispenser.

8. The apparatus of claim 1, wherein the means for building and storing energy, and for releasing the stored energy moves the packaging material holder to a reset position as the stored energy is released.

9. The apparatus of claim 1, wherein the means for building and storing energy, and for releasing the stored energy moves the packaging material holder to a fully extended position as the stored energy is released.

10. The apparatus of claim 1, wherein the means for building and storing energy, and for releasing the stored energy is a spring, and wherein the spring is loaded to move the packaging material holder to a fully extended position, and wherein the spring is unloaded to move the packaging material holder to a reset position.

11. The apparatus of claim 1, wherein the packaging material holder includes jaws for grasping the packaging material.

12. The apparatus of claim 1, further including a packaging material weakener.

13. The apparatus of claim 1, further including a packaging material weakener, wherein the packaging material weakener includes an opposed cutting element.

14. The apparatus of claim 1, further including a packaging material weakener for weakening the packaging material between the load and the packaging material holder, wherein the packaging material holder severs the weakened packaging material as it moves upstream toward the dispenser in response to the release of the stored energy.

15. The apparatus of claim 1, further including a packaging material severer.

16. The apparatus of claim 1 further including means for securing a trailing end of packaging material to the load.

17. The apparatus of claim 1, further including means for roping the packaging material into the packaging material holder.

18. The apparatus of claim 1, further including a packaging material holder guard for protecting the packaging material holder.

19. The apparatus of claim 1, further including a packaging material holder guard for protecting the packaging material holder, the packaging material guard including a backstop positioned on the turntable between the packaging material holder and a load support surface of the turntable for supporting the load during wrapping.

20. An apparatus for wrapping a load with packaging material, comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including a spring for building and storing energy, and for releasing the stored energy to move the packaging material holder, wherein the spring is loaded to move the packaging material holder to a reset position and wherein the spring is unloaded to move the packaging material holder to a fully extended position.

21. An apparatus for wrapping a load with packaging material, comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including jaws for grasping and releasing the packaging material, and a spring for building and storing energy through rotation of the turntable, and for releasing the stored energy, the spring moveably connected to the jaws of the packaging material holder; wherein the spring is loaded as the turntable rotates and the jaws move away from the packaging material dispenser.

22. An apparatus for wrapping a load with packaging material, comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including jaws for grasping and releasing the packaging material, and a spring for building and storing energy through rotation of the turntable, and for releasing the stored energy, the spring moveably connected to the jaws of the packaging material holder, wherein the spring moves the jaws of the packaging material holder toward the packaging material dispenser as it unloads to release the stored energy.

23. An apparatus for wrapping a load with packaging material, comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including means for building and storing energy through rotation of the turntable, and for releasing the stored energy to move the packaging material holder and jaws for grasping the packaging material, wherein the jaws are mounted to move downstream along a path on the turntable in response to the rotation of the turntable.

24. An apparatus for wrapping a load with packaging material comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including means for building and storing energy through rotation of the turntable, and for releasing the stored energy to move the packaging material holder and jaws for grasping the packaging material, wherein the jaws are mounted to move upstream along a path on the turntable toward the packaging material dispenser in response to the release of the stored energy.

25. An apparatus for wrapping a load with packaging material comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including means for building and storing energy, and for releasing the stored energy to move the packaging material holder, wherein the means for building and storing energy, and for releasing the stored energy uses movement of the turntable to build and store the energy.

26. An apparatus for wrapping a load with packaging material, comprising:

a dispenser for dispensing packaging material;

a rotatable turntable for providing relative rotation between the dispenser and the load to wrap packaging material around the load; and a packaging material holder mounted on the rotatable turntable, said holder being isolated from electrical and fluid power sources by the rotatable turntable for automatically grasping and releasing portions of the packaging material, the packaging material holder including a spring for building and storing energy, and for releasing the stored energy to move the packaging material holder, wherein the movement of the turntable builds and stores energy by loading the spring.

27. An apparatus for wrapping a load with packaging material, comprising:

a dispenser for dispensing packaging material;

a rotatable turntable for providing relative rotation between the dispenser and the load to wrap packaging material around the load;

a packaging material holder mounted on the rotatable turntable, said holder being isolated from electrical and fluid power sources by the rotatable turntable for automatically grasping and releasing portions of the packaging material, the packaging material holder including means for building and storing energy through rotation of the turntable, and for releasing the stored energy to move the packaging material holder; and a packaging material holder guard for protecting the packaging material holder, the packaging material guard including a backstop positioned on the turntable between the packaging material holder and a load support surface of the turntable for supporting the load during wrapping, wherein a distal portion of the backstop intercepts the packaging material between the load and the dispenser to provide a necessary angle between the packaging material and the packaging material dispenser and a graspable tail of packaging material extending from the dispenser after the packaging material is severed.

* * * * *